US008950025B2

(12) United States Patent
Kaminski, Jr.

(10) Patent No.: US 8,950,025 B2
(45) Date of Patent: Feb. 10, 2015

(54) PILLOW STAY

(71) Applicant: Mitchell V Kaminski, Jr., Niles, IL (US)

(72) Inventor: Mitchell V Kaminski, Jr., Niles, IL (US)

( * ) Notice: Subject to any disclaimer, the term of this patent is extended or adjusted under 35 U.S.C. 154(b) by 0 days.

(21) Appl. No.: 13/732,889

(22) Filed: Jan. 2, 2013

(65) Prior Publication Data

US 2013/0167297 A1 Jul. 4, 2013

Related U.S. Application Data

(60) Provisional application No. 61/631,330, filed on Jan. 3, 2012.

(51) Int. Cl.

| | |
|---|---|
| ***A47C 21/02*** | (2006.01) |
| ***A47G 9/04*** | (2006.01) |
| ***A61G 7/075*** | (2006.01) |
| ***A47C 20/00*** | (2006.01) |

(52) U.S. Cl.

CPC ..... *A47G 9/04* (2013.01); *A61G 7/0755* (2013.01); *A47C 20/021* (2013.01)

USPC ..... 5/498; 5/485; 5/490; 5/492; 5/499; 5/504.1

(58) Field of Classification Search

CPC ..... A47C 31/105; A47C 21/022; A47D 15/02

USPC ..... 5/485, 490, 491, 492, 498, 499, 504.1, 5/630, 648, 652, 494, 496; 24/72.5

See application file for complete search history.

(56) References Cited

U.S. PATENT DOCUMENTS

| | | | | | |
|---|---|---|---|---|---|
| 2,223,412 | A | * | 12/1940 | Gartz | 24/72.5 |
| 2,586,031 | A | * | 2/1952 | Hahne | 5/485 |
| 3,346,892 | A | | 10/1967 | Du Priest | |
| 3,506,988 | A | | 4/1970 | Saddoris | |
| 3,901,228 | A | * | 8/1975 | Brown | 5/651 |
| 4,391,010 | A | * | 7/1983 | Kronman | 5/484 |
| 4,574,412 | A | | 3/1986 | Smith | |
| 4,599,756 | A | * | 7/1986 | Koffler | 5/484 |
| 4,625,352 | A | * | 12/1986 | Kobayashi | 5/498 |
| 4,675,925 | A | * | 6/1987 | Littleton | 5/607 |
| 4,716,608 | A | * | 1/1988 | Whitfield | 5/669 |
| 4,884,305 | A | * | 12/1989 | Blackmon | 5/496 |
| 5,404,602 | A | * | 4/1995 | Kondo | 5/504.1 |
| 5,497,521 | A | * | 3/1996 | Waits et al. | 5/658 |
| 5,836,023 | A | * | 11/1998 | Stone Munson | 5/482 |
| 6,014,782 | A | * | 1/2000 | Stevenson | 5/499 |
| 6,216,292 | B1 | * | 4/2001 | Oakhill et al. | 5/482 |
| 6,233,762 | B1 | * | 5/2001 | Bradley | 5/484 |

(Continued)

FOREIGN PATENT DOCUMENTS

| | | | |
|---|---|---|---|
| JP | 2001321260 | A | 11/2001 |
| JP | 2008093374 | A | 4/2008 |
| TW | M423520 | | 3/2012 |

*Primary Examiner* — Nicholas Polito

*Assistant Examiner* — David R Hare

(74) *Attorney, Agent, or Firm* — Vedder Price P.C.

(57) ABSTRACT

A device for securing a pillow or other support to a bed includes a pocket configured to receive a pillow insert, a tail comprising a proximal end and a distal end with the tail connected to the pocket at the proximal end. The device further includes a retention element located near the distal end of the tail. The retention element is further configured to retain the pillow insert relative to the bed by tucking the retention element under the mattress of the bed.

4 Claims, 4 Drawing Sheets

(56) References Cited

U.S. PATENT DOCUMENTS

| | | | | |
|---|---|---|---|---|
| 6,438,805 | B1 | 8/2002 | Goss | |
| 6,539,565 | B1 * | 4/2003 | Trimble | 5/485 |
| 6,666,426 | B1 | 12/2003 | Taylor | |
| 7,069,607 | B2 * | 7/2006 | Nichols | 5/420 |
| 7,120,952 | B1 * | 10/2006 | Bass et al. | 5/484 |
| 7,152,260 | B2 * | 12/2006 | Ota | 5/504.1 |
| 7,174,585 | B1 * | 2/2007 | Sorrentino et al. | 5/417 |
| 7,370,377 | B2 * | 5/2008 | Landry | 5/494 |
| 7,865,987 | B2 | 1/2011 | Deetsch | |
| 8,171,586 | B2 * | 5/2012 | Clack | 5/658 |
| 8,566,983 | B2 * | 10/2013 | Monaco | 5/498 |
| 2009/0172881 | A1 * | 7/2009 | Peterson | 5/496 |
| 2010/0269259 | A1 * | 10/2010 | Campbell | 5/498 |
| 2012/0180214 | A1 | 7/2012 | Borgione | |
| 2013/0139315 | A1 * | 6/2013 | Pimenta | 5/421 |

* cited by examiner

PILLOW STAY

RELATED APPLICATIONS

This application is related to and claims the benefit of U.S. Provisional Patent Application No. 61/631,330 filed on Jan. 3, 2012 the contents of which are incorporated herein by reference.

BACKGROUND

In the treatment of wounds or pressure ulcers, it is often advantageous to raise or immobilize the affected area such that proper healing can occur. The raising of the portion of the anatomy that is affected allows blood to flow to the area that can carry oxygen and other nutrients to the wound or ulcer to assist in the healing process. Additionally, individuals who are unable to move due to injury, old age, or other condition can develop pressure ulcers from prolonged contact between certain parts of the body and support surfaces such as a bed. Individuals susceptible to pressure ulcers are often moved or rotated to prevent pressure ulcers from occurring. The raising of certain body parts above the support surface or bed can also assist in the prevention of pressure ulcers.

In order to assist in the healing of wounds or ulcers or to prevent pressure ulcers from occurring a structure such as a pillow can be placed under an affected or at risk body part. Often, though, the pillow moves or slides out of position causing discomfort for the individual or causing the affected body part to return to its position against the bed. The movement of pillows or structures used to raise body parts limits the effectiveness of such treatment and can lead to prolonged healing time or the development of pressure ulcers.

Therefore, there exists a need for a device to retain a pillow or other structure in position relative to a bed, chair or other piece of furniture such that when an injured body part or at risk body part is raised it remains comfortably raised such that healing and blood flow can occur. Such a device is needed that can be easily used in a variety of environments and configurations such as on hospital beds and other medical support structures. Further needed aspects of a device include the ability to be easily removed, re-positioned, and locked and unlocked into position relative to the bed or other support structure. A wide variety of hospital beds and bed platforms exist such that the versatility of the device and the versatility of the retention feature of the device are useful aspects of a pillow retention device.

SUMMARY

In one example of the present disclosure, a device for securing a pillow to a bed is provided. The device includes a pocket configured to receive a pillow insert, a tail comprising a proximal end and a distal end with the tail connected to the pocket at the proximal end. The device further includes a retention element located near the distal end of the tail. The retention element is further configured to retain the pillow insert relative to the bed by tucking the retention element under the mattress of the bed.

The device for securing a pillow to a bed may also include an opening through which a pillow insert may be installed into the pocket of the device.

The retention element of the device can be an object with a height larger that the thickness of the tail such that the retention element protrudes above and below the thickness of the tail.

The retention element of the device may be various objects such as a sphere, a ring, or a signet ring.

The device for securing a pillow in position relative to a bed may also include a second tail. The second tail may also be connected to the pocket such that a first tail and the second tail extend from one side of the pocket. The device may also include a third and fourth tail. The third and fourth tail may also be connected to the pocket and extend from a second side of the pocket.

BRIEF DESCRIPTION OF THE DRAWINGS

The following disclosure as a whole may be best understood by reference to the provided detailed description when read in conjunction with the accompanying drawings, drawing description, abstract, background, and associated headings. Identical reference numerals when found on different figures identify the same elements or a functionally equivalent element.

DETAILED DESCRIPTION

The present disclosure is not limited to the particular details of the apparatus, assembly, systems or methods depicted, and other modifications and applications may be contemplated. Further changes may be made to the apparatus, assembly, systems or methods without departing from the true spirit of the scope of the disclosure herein involved. It is intended, therefore, that the subject matter in this disclosure should be interpreted as illustrative, not in a limiting sense.

Figure 1:
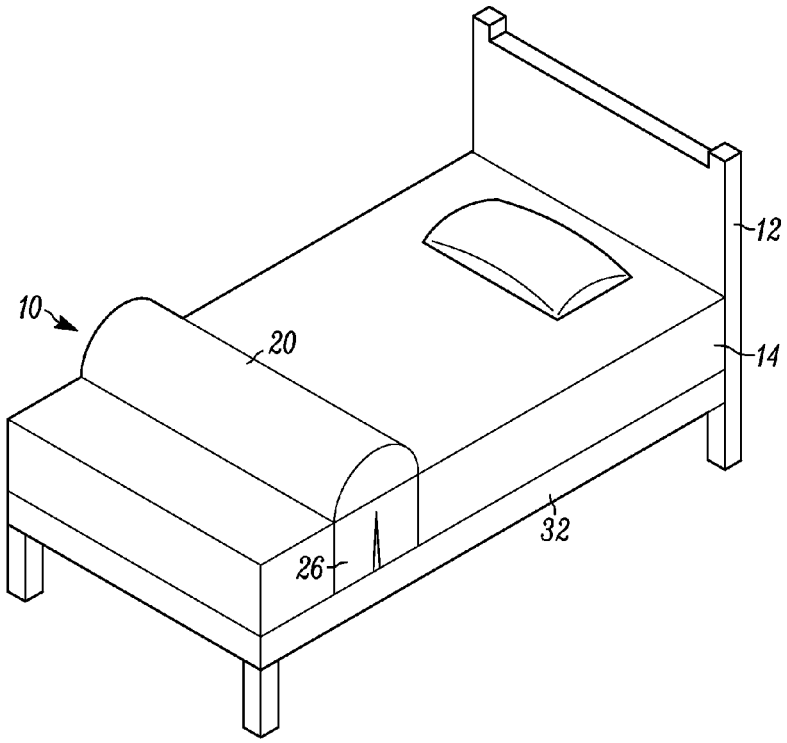
FIG. 1 is an illustration of one embodiment of the pillow stay of the present disclosure on a bed.

FIG. 1 illustrates one embodiment of a pillow stay of the present disclosure as used on a bed. Pillow stay 10 is shown secured on mattress 14 of bed 12. Pillow stay 10, as shown in FIG. 1, is used with bed 12 but pillow stay 10 can also be used with a variety of other sleeping or support structures as well. Other examples of structures that pillow stay 10 can used in conjunction with include cots, chairs, matts, ottomans, cushions, and the like. Pillow stay 10 can be configured to span the width of bed 12 (or other support structure) such that pocket 20 extends across bed 12 and tail 26 can be tucked between mattress 14 and bed platform 32 as will be explained below.

Figure 2:
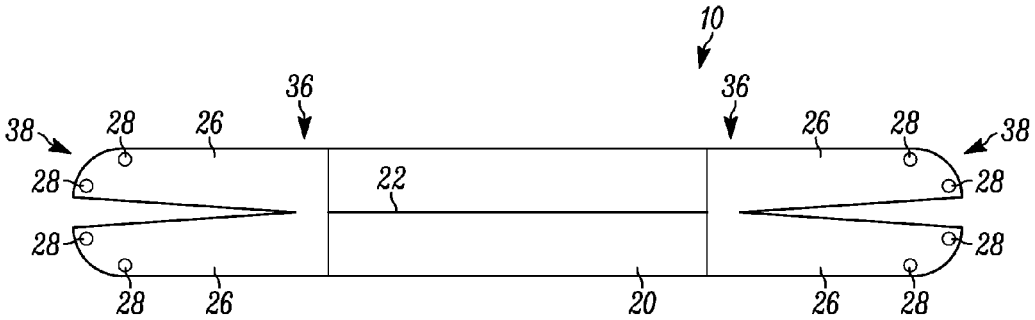
FIG. 2 is an illustration of another embodiment of the pillow stay of the present disclosure.

FIG. 2 illustrates one embodiment of pillow stay 10. Pillow stay 10 may include pocket 20, one or more tails 26, one or more retention elements 28, and opening 22. Pillow stay 10 can be constructed of many different materials known to one of ordinary skill in the art. In one example, pillow stay 10 can be made of woven cotton material. In other examples, pillow stay 10 can be made of other natural or synthetic textile materials such as, but not limited to, polyester, acrylic, wool, or combinations of any of the foregoing.

In one example, Pillow stay 10 may include pocket 20 that may include opening 22. Pocket 20 is the feature of pillow stay 10 that is configured to hold or surround one or more pillow inserts. Any suitable pillow insert may be used in conjunction with pillow stay 10 as are known to one of ordinary skill in the art. Pillow inserts constructed of synthetic fill material, down, or various types of foam, or the like may be used. Pocket 20 can be a stitched compartment, appropriately sized according to the desired pillow insert. Pocket 20 may include opening 22. Opening 22 may be included so that a pillow insert can be inserted into pocket 20 and removed. This functionality may be desirable in order to clean or launder pillow stay 10 or change the size or type of the pillow insert used in conjunction with pillow stay 10. As shown in the example of FIG. 2, opening 22 is a longitudinal slit extending down the middle of pocket 20. Other configurations may also be used such as a transverse slit extending across a portion of the width of pocket 20. Pillow stay 10 may also include more than one opening or more than one pocket such that multiple pillow inserts can be removably installed in pillow stay 10 to provide flexibility and versatility of use. In other examples of pillow stay 10, opening 22 can be configured to include a flap, a zipper, buttons, or other features to allow opening 22 to be opened and closed.

Pillow stay 10, in one embodiment, includes one or more tails 26. As shown in FIG. 2, pillow stay 10 includes four tails 26 with two extending from each side of pocket 20. Each tail, in this example, includes a proximal end 36 attached to pocket 20 and a distal end 38. In this embodiment, tails 26 at each end of pocket 20 are configured similar to the "tails" of a tuxedo coat. Tails 26 are separated by a slit down the middle of the material. The material of tails 26 can be the same as that of pocket 20 or they can be made of different material. Tails 26 and pocket 20 can be constructed of an appropriately sized single piece of material or tails can be made of separate pieces of material stitched or otherwise joined to the material of pocket 20.

Figure 5:
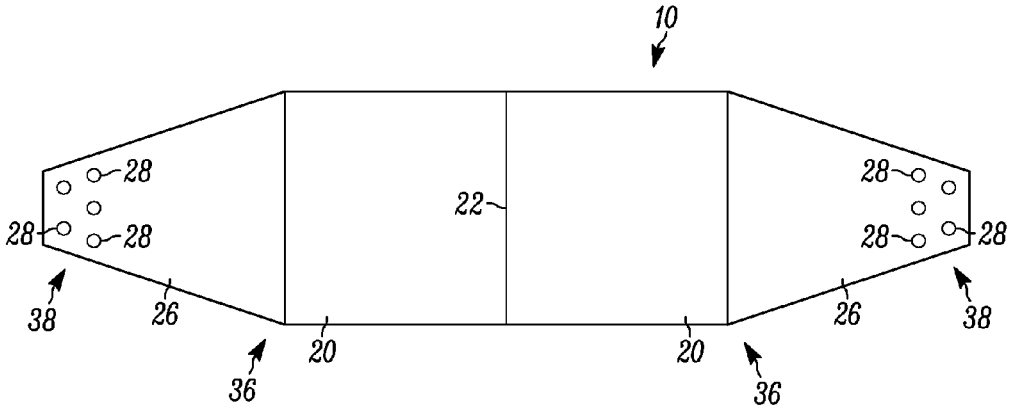
FIG. 5 is an illustration of another embodiment of the pillow stay of the present disclosure.

Tail 26, in other embodiments, can have different shapes. FIG. 5 shows another example configuration of pillow stay 10 that includes pocket 20 with a transversely oriented opening 22 and tails 26. In this embodiment, a single tail 26 with a tapering width extends from each side of pocket 20. Pillow stay 10 can also have multiple other configurations of tail 26, pocket 20, and opening 22 as are known to one of ordinary skill in the art.

In other embodiments, tail 26 may include retention element 28. Retention element 28 is a feature of pillow stay 10 that helps to retain tail 26 in its position after it is placed into position such as between mattress 14 and bed platform 32. Retention element 28 can be a variety of shapes and configurations so long as it aids in retaining tail 26 in position and helps to prevent the movement of pillow stay 10 and a pillow insert contained therein relative to bed 12. In one embodiment, as shown in FIG. 2, retention element is a sphere located near the distal end 38 of tail 26. In this example, two retention elements 28 are located on each tail 26. The spherical retention element 28, in this example, is approximately one inch in diameter and made of plastic. Other sizes and materials may also be used, however, as are known to one of ordinary skill in the art. Further as shown in the embodiment of FIG. 2, the retention elements 28 are staggered in position on tail 26. The first retention element is near the distal end 38 of tail 26 and located near the slit that separates the first and second tail 26 positioned on one end of pocket 20. A second retention element is further outboard of the first retention element and located closer to pocket 20.

In other embodiments, different configurations and different numbers of retention elements 28 can also be used. In another embodiment, shown in FIG. 5, five staggered retention elements can be used. Further still, in the various embodiments shown in FIGS. 6-8, a single retention element is used on each tail 26.

Figure 6:
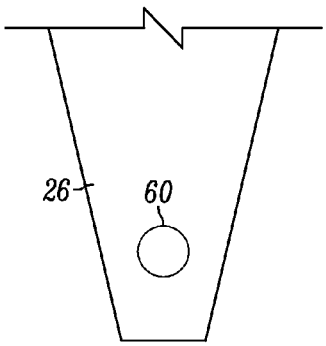
FIG. 6 is an illustration of one embodiment of a tail and retention element of the present disclosure.

In addition to the spherically-shaped retention element 26 described above, pillow stay 10 may include other configurations of retention elements. As illustrated in FIG. 6, a larger single spherically-shaped retention element may be used. In this example, the single spherically-shaped retention element 60 is positioned centrally to tail 26 near the distal end 38.

Figure 7:
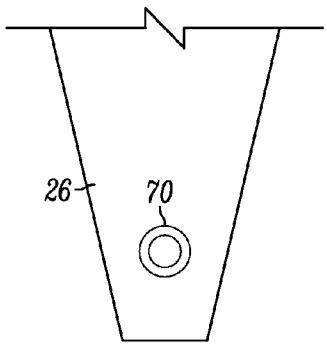
FIG. 7 is an illustration of another embodiment of a tail and retention element of the present disclosure.
Figure 9:
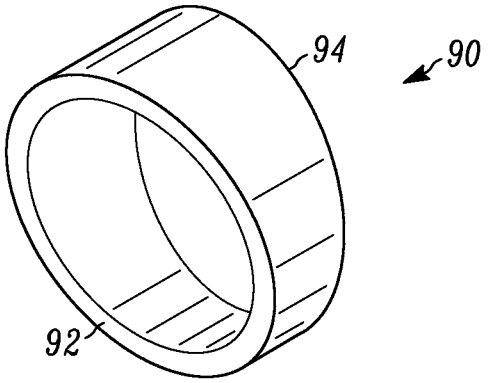
FIG. 9 is an illustration of another embodiment of a retention element of the present disclosure.

In another example, illustrated in FIG. 7, retention element 28 may be a ring 70. In this example, ring 70 is centrally located on tail 26 near distal end 38. Other positions may also be used or multiple rings 70 may be employed. In one example, ring 70 is cylinder approximately one-half inches in height with a one inch diameter. Ring 70 can be made of various materials known to one of ordinary skill in the art such as, but not limited to, plastic, metal, wood, rubber or the like. Ring 70 may also be of different shapes rather than a cylinder. Ring 70 can be rounded or be signet ring shaped. In the signet ring 90 configuration, illustrated in FIG. 9, top face 92 and bottom face 94 are not parallel as would be the case in a cylinder. Instead top face 92 and bottom face 94 angle towards each such the height of the cylinder varies around the circumference of the ring.

Figure 8:
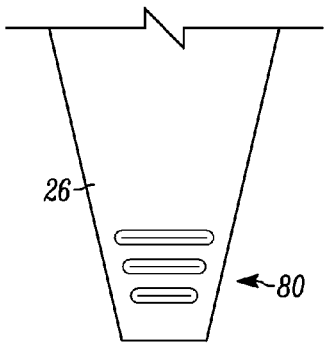
FIG. 8 is an illustration of another embodiment of a tail and retention element of the present disclosure.

In still another embodiment, illustrated in FIG. 8, retention element 28 consists of a gripping material 80 attached to or deposited on tail 26. Gripping material 80 can be any material that assists in maintaining the position of tail 26. Some examples of gripping material 80 include, but are not limited to, rubber, hook and loop fasteners, releasable glue, plastic, felt, or other materials with high friction properties or the like. Gripping material 80 can be deposited on tail 26 in any suitable pattern or quantity. In one embodiment, as shown in FIG. 8, gripping material 80 is deposited on tail 26 in a plurality of strips but other patterns, layouts, or configurations known to one of ordinary skill in the art can be used.

Referring back to retention element 28, retention elements 28 (such as spheres or rings) are attached to tail 26 of pillow stay 10. Any suitable method of attachment can be used such that retention element 28 is secured to tail 26 to resist the movement of tail 26 relative to bed 12. In one embodiment, retention element 28 can be sewn into the material of tail 26. In another embodiment, retention element 28 can be positioned between two layers of material of tail 26. Stitching, in this embodiment is then made around the periphery of retention element 28 and through the two layers of material. In other embodiments, retention element 28 is attached to tail 26 via other methods such as hook and loop fasteners, snaps, adhesive, or the like. In still other embodiments, tail 26 can be equipped with one or more pouches for holding the one or more retention elements 28. In these embodiments, the pouches can have zippers, buttons, flaps, or other suitable features such that retention elements 28 can be removed from and reinserted into tail 26.

Pillow stay 10 can be used in a variety of settings and environments. One such use of pillow stay 10 is for use with a hospital bed. The following description includes the use of pillow stay 10 in conjunction with a hospital bed but the operation and methods of use described below can also be applied to the use of pillow stay 10 with other support structures.

Figure 3:
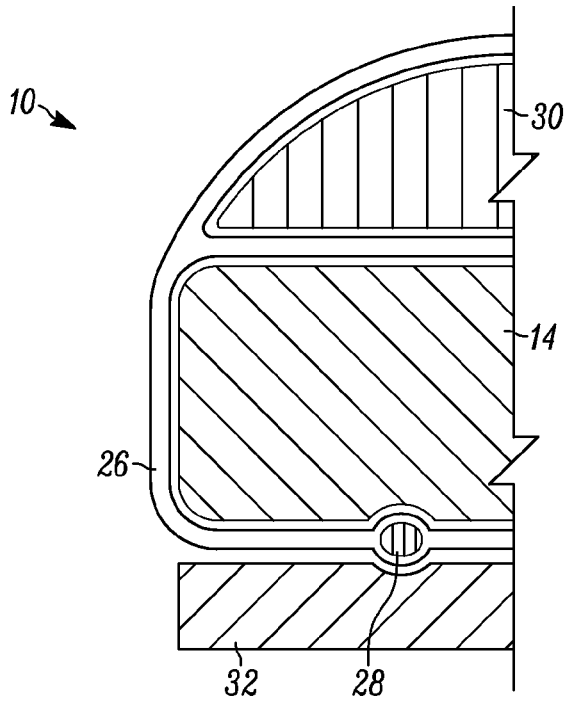
FIG. 3 is a cross-sectional illustration of another embodiment of the pillow stay of the present disclosure installed on a bed.

As described above, pillow stay 10 includes pocket 20 that is configured to hold a pillow insert. Opening 22 allows a user of pillow stay 10 to install a pillow insert into pocket 20. Pillow stay 10 can then be positioned into an appropriate location on a bed. FIG. 1 illustrates the use of pillow stay 10 at the foot of bed 12. As shown in FIG. 1 and as further illustrated in FIG. 3, tails 26 of pillow stay 10 are wrapped around mattress 14 and tucked between mattress 14 and bed platform 32. In this manner, the weight of mattress 14 (and the weight of a bed occupant) effectively traps tail 26 and prevents movement of pillow stay 10 relative to bed 12. To further impede the movement of pillow stay 10, retention element 28 (a spherically-shaped retention element in this example) is also trapped in between mattress 14 and bed platform 32.

As can be appreciated by one of ordinary skill in the art, bed platform 32 and mattress 14 can have many different configurations. Different configurations of retention element 28 can advantageously interact with the different configurations of bed platforms and mattresses. For example, the signet ring 90 may provide effective retention of pillow stay 10 when used in combination with a bed platform that includes springs, a wire lattice structure, or multiple slats. A spherically-shaped retention element may work well with an air mattress and solid bed platform. Still further, gripping material 80 may be used in conjunction with metal bed platforms or with other bed platforms exhibiting a smooth surface. Given the variety of beds and environments in which pillow stay 10 may used, a variety of retention elements may be provided on tails 26 of pillow stay 10. In one embodiment, a ring, a sphere, and gripping material are provided on a single tail of pillow stay 10. Such an embodiment can provide a single pillow stay 10 that can be effectively used in conjunction with multiple different environments. Other combinations of retention elements 28 can also be used to meet the needs of a specific environment or provide the desired versatility of pillow stay 10.

In addition to the various configurations of retention elements 28, the configuration of tails 26 can also provide versatility of pillow stay 10. As described above, pillow stay 10 can have multiple different configurations of tails 26. Pillow stay 10 may have a single tail 26 extending from each side of pocket 20 or may have more than one tail 26 extending from each side of pocket 20. In one embodiment, shown in FIGS. 1, 2, and 4, pillow stay 10 has a pair of tails 26 extending from a side of pocket 20. An embodiment such as this one, with two tails 26, can be used in conjunction with a bed that includes an overlay on mattress 14. As known to one of ordinary skill in the art, some beds, such as hospital beds, can be fitted with an overlay to soften the mattress surface. Such an overlay may include straps that hold the overlay in position on mattress 14. As can be appreciated, an embodiment of pillow stay 10 that includes a pair of split tails 26 can be used on or under an overlay fitted on a mattress because each tail 26 can be used, and tucked into position, on either side of a strap that may hold an overlay in position on mattress 14. Further, other configurations of tails 26 on pillow stay 26 can also be used to provide the retention of pillow stay 10 with respect to mattress 14 such as, but not limited to, other numbers, shapes, and profiles of tails 26.

Figure 4:
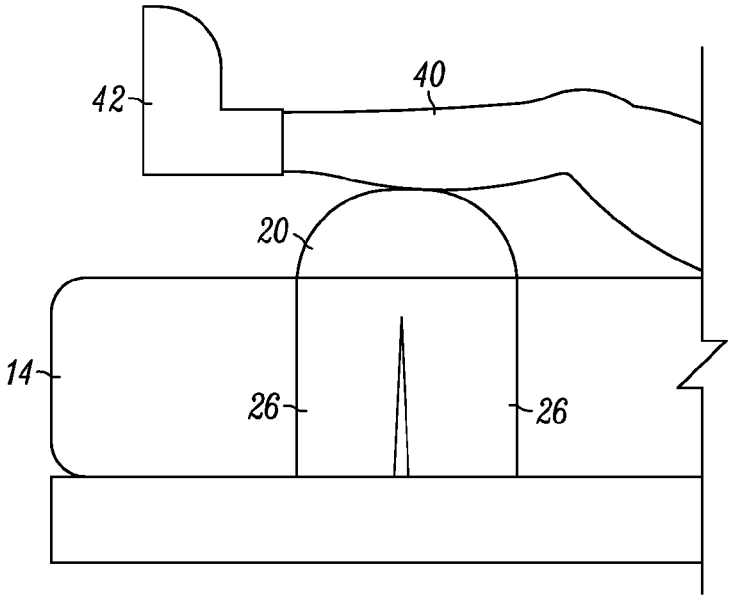
FIG. 4 is an illustration of another embodiment of the pillow stay of the present disclosure.

One use of pillow stay 10 is to lift or float an injured body part of a patient. For example, as illustrated in FIG. 4, pillow stay 10 can be used to raise the foot of a patient above mattress 14 such that a wound located on the foot of a patient can heal. Pillow stay 10 and pocket 20 can be configured to hold one or more pillow inserts that are appropriately sized and positioned to comfortably raise a patient's leg. In one embodiment, pocket 20 is divided into two pockets that each can hold a pillow for each of the patient's two legs. As can be appreciated by one of ordinary skill in the art, with this configuration, the pillow stay can be used with one pocket holding a pillow insert for one of the patient's legs while the other pocket is empty so that the patent's uninjured leg can lie flat against mattress 14. Other configurations of pocket 20 and pillow insert 30 can also be used to appropriately raise various different body parts above mattress 14.

As stated above and as illustrated in FIG. 4, pillow stay 10 can be used in conjunction with boots or other devices that relieve the pressure on a wound or ulcer located on the foot. As such pillow stay 10 can be appropriately configured to be used by a patient wearing a pressure relieving boot. In one example, pillow insert is made of a foam sized and adapted for use with a pressure-relieving boot. As such, different pillow inserts be interchangeably installed into pillow stay 10 for use with multiple different sizes, shapes, and manufacturers of pressure-relieving boots. Pillow stay 10 can also be adapted for use with other medical devices that may benefit from the ability of pillow stay 10 to be retained to a bed or other support structure.

The preceding detailed description is merely some examples and embodiments of the present disclosure and that numerous changes to the disclosed embodiments can be made in accordance with the disclosure herein without departing from its spirit or scope. The preceding description, therefore, is not meant to limit the scope of the disclosure but to provide sufficient disclosure to one of ordinary skill in the art to practice the invention without undue burden.

The invention claimed is:

1. A device for securing a pillow insert to a bed comprising:
- a pocket configured to removably receive a pillow insert;
- a first tail and a second tail attached to and extending from the pocket, the first tail attached to a first end of the pocket and the second tail attached to a second end of the pocket, wherein the first tail further comprises a top layer and a bottom layer;
- a first retention element connected to the first tail, said first retention element located between the top layer and the bottom layer; and
- a second retention element connected to the second tail wherein when the first tail and the second tail are positioned under a mattress of the bed, the first tail and the second tail prevent movement of the pillow insert without being connected to one another, wherein the first retention element and the second retention element are spheres.

2. The device of claim 1 wherein a panel of said pocket defines an opening, the opening configured to accept the pillow insert for removable placement in the pocket.

3. The device of claim 1 wherein the first retention element has a height larger than a thickness of the first tail and such that at least a portion of the first retention element extends above the thickness of the first tail.

4. A device for securing a pillow to a bed comprising:
- a pocket configured to receive a pillow insert;
- a first tail comprising a proximal end and a distal end, the first tail connected to the pocket at the proximal end;
- a second tail, the second tail connected to the pocket at a proximal end of the second tail such that the first and the second tails extend from one side of the pocket; and
- a third tail and a fourth tail, the third tail and the fourth tail each connected to the pocket at proximal ends of the third tail and the fourth tail such that the third tail and the fourth tail extend from a second side of the pocket;

wherein the first tail, the second tail, the third tail, and the fourth tail include retention elements located near distal ends of the first tail, the second tail, the third tail, and the fourth tail such that when the first tail and the second tail are positioned under one edge of the mattress and the third tail and the fourth tail are positioned under an opposite edge of the mattress, weight of the mattress traps the first tail, the second tail, the third tail and the fourth tail and prevents movement of the pillow insert relative to the bed without connecting the distal ends of first tail, the second tail, the third tail or the fourth tail together;

wherein the retention elements are each one of a sphere, a ring, and a signet ring positioned between two layers of material on the first tail, the second tail, the third tail and the fourth tail.

* * * * *